US008707602B1

(12) United States Patent
Robertson

(10) Patent No.: US 8,707,602 B1
(45) Date of Patent: Apr. 29, 2014

(54) ELECTRIC FIRE MUZZLE LOADER

(71) Applicant: Sean Robertson, Deming, NM (US)

(72) Inventor: Sean Robertson, Deming, NM (US)

( * ) Notice: Subject to any disclaimer, the term of this patent is extended or adjusted under 35 U.S.C. 154(b) by 0 days.

(21) Appl. No.: 13/841,384

(22) Filed: Mar. 15, 2013

(51) Int. Cl.
*F41C 9/08* (2006.01)
*F41A 19/63* (2006.01)

(52) U.S. Cl.
USPC ..... 42/51; 42/84; 89/1.3; 89/28.05

(58) Field of Classification Search
USPC ..... 42/51, 69.01, 69.02, 69.03, 84; 89/1.3, 89/28.05, 28.1
See application file for complete search history.

(56) References Cited

U.S. PATENT DOCUMENTS

| | | | | |
|---|---|---|---|---|
| 317,545 | A | 5/1885 | Kinsman | |
| 2,135,843 | A * | 11/1938 | Pye | 310/36 |
| 2,789,005 | A * | 4/1957 | Foster | 294/86.26 |
| 3,267,810 | A * | 8/1966 | Lancaster | 89/1.816 |
| 4,148,245 | A * | 4/1979 | Steffanus et al. | 89/7 |
| 4,715,261 | A * | 12/1987 | Goldstein et al. | 89/8 |
| 4,974,487 | A * | 12/1990 | Goldstein et al. | 89/7 |
| 5,431,105 | A * | 7/1995 | Wilkinson | 102/430 |
| 5,896,691 | A | 4/1999 | Kaminski et al. | |
| 7,197,843 | B2 | 4/2007 | Oertwig | |
| 7,770,504 | B2 * | 8/2010 | Tippmann et al. | 89/7 |
| 7,819,051 | B1 | 10/2010 | Beckmann et al. | |
| 8,234,969 | B2 | 8/2012 | Beckmann | |
| 2004/0068909 | A1 * | 4/2004 | Bideev et al. | 42/84 |
| 2005/0257676 | A1 * | 11/2005 | Ealovega | 89/28.1 |

* cited by examiner

*Primary Examiner* — Bret Hayes
(74) *Attorney, Agent, or Firm* — Robert C. Montgomery; Montgomery Patent & Design

(57) ABSTRACT

An electrically-ignited muzzle loader is provided having a stock portion, a trigger assembly, and a barrel portion. The trigger assembly is electrically coupled to a spark plug which extends partially into the barrel portion of the gun. Within the stock is a hand cranked magneto for generating an electric charge. The magneto is electrically coupled to capacitor and coil portions to configure the electrical charge so as to cause the spark plug to generate an igniting spark.

20 Claims, 4 Drawing Sheets

ELECTRIC FIRE MUZZLE LOADER

RELATED APPLICATIONS

Not applicable.

FIELD OF THE INVENTION

The present invention relates generally to a firearm comprising an electrical-generating mechanism to produce a spark to ignite a projectile.

BACKGROUND OF THE INVENTION

Many people still enjoy the use of muzzleloader style fire arms which utilize black powder. Such fire arms utilize the principle of striking flint and steel together to produce a spark which ignites the black power, and propels a projectile forward. As such, when a gun is fired, a small piece of flint is propelled by a spring when the trigger is depressed. The flint then strikes down on a hardened steel face, and produces a spray of sparks. The sparks, with the use of primer powder, then ignites the main charge. Several technological advancements have been achieved to obviate the problems with black powder ordinances and muzzleloader style firearms, but many people enjoy the nostalgia and challenges associated with such firearms. However, as one could imagine, such a mechanical system is not always reliable, and often results in misfires and subsequent missed shots. Accordingly, there exists a need for a means by which the spark producing process on muzzleloaders firearms can be improved to prevent the problems as described above.

Existing art in this field employ electrical ignition systems to combat the above-referenced problem of reliability. While these systems address the reliability issue of the firing mechanism, these systems have problems of their own. These electronic firing systems either require special ammunition or a battery or external supply for electricity, or both. Furthermore, these systems fail to provide a means to access the mechanism for maintenance and servicing. In addition, some of these systems are elaborate and expensive. It is desirous to have a firearm that discharges black powder ordinances, but also utilizes a more reliable method of ignition. It is further desirous for such a firearm to incorporate a device within its internal mechanics to achieve this. It would be beneficial for this device to be readily accessible, removable, and replaceable to accommodate maintenance and servicing due to soot and other particulate deposition from black powder combustion.

SUMMARY OF THE INVENTION

The present invention relates to an electrically-ignited muzzle loader, which provides a muzzleloader-style firearm utilizing an electric means to produce a spark during the firing of the firearm. The device comprises a firearm that discharges black powder ordnance, wherein the firing mechanism comprises of components to produce an electrical charge to ignite the black powder charge. The electrical components further comprises a wind-up-type magneto assembly, a capacitor, a coil, a spark plug, a pair of plates, a cover, and a plurality of electrical wires and connectors. Electric current is produced by the wind-up-type magneto assembly located within a portion of the firearm. The magneto assembly further comprises a shaft, a system of stationary and rotating magnets, and a crank arm. The crank arm serves to allow a user to wind the magneto assembly. The magneto assembly is provided with a cover having an access aperture to allow egress to a shaft portion of the assembly. A circuit is formed by interconnection of the magneto assembly, the capacitor, the trigger mechanism, and the coil via the plurality of electrical wires. The trigger mechanism utilizes a pair of points to conduct the electrical charge to the spark plug. Electrical current from the magneto assembly is stored within the capacitor until the trigger mechanism closes the circuit. Once the circuit is closed, current it directed through the coil and arced across a gap portion of the spark plug. The spark from the plug ignites the black powder.

A user pre-loads black powder and necessary ordnance into the bore and chamber portions of the firearm. The crank arm is rotated to charge the capacitor. The trigger is actuated to close the circuit and cause the spark plug to produce a spark, which ignites the black powder. The system neither requires a battery source nor an external electrical supply. The system further comprises of cost-effective parts that are commonly found in the market. The system is provided with access to enable proper maintenance of the device.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

Figure 1:
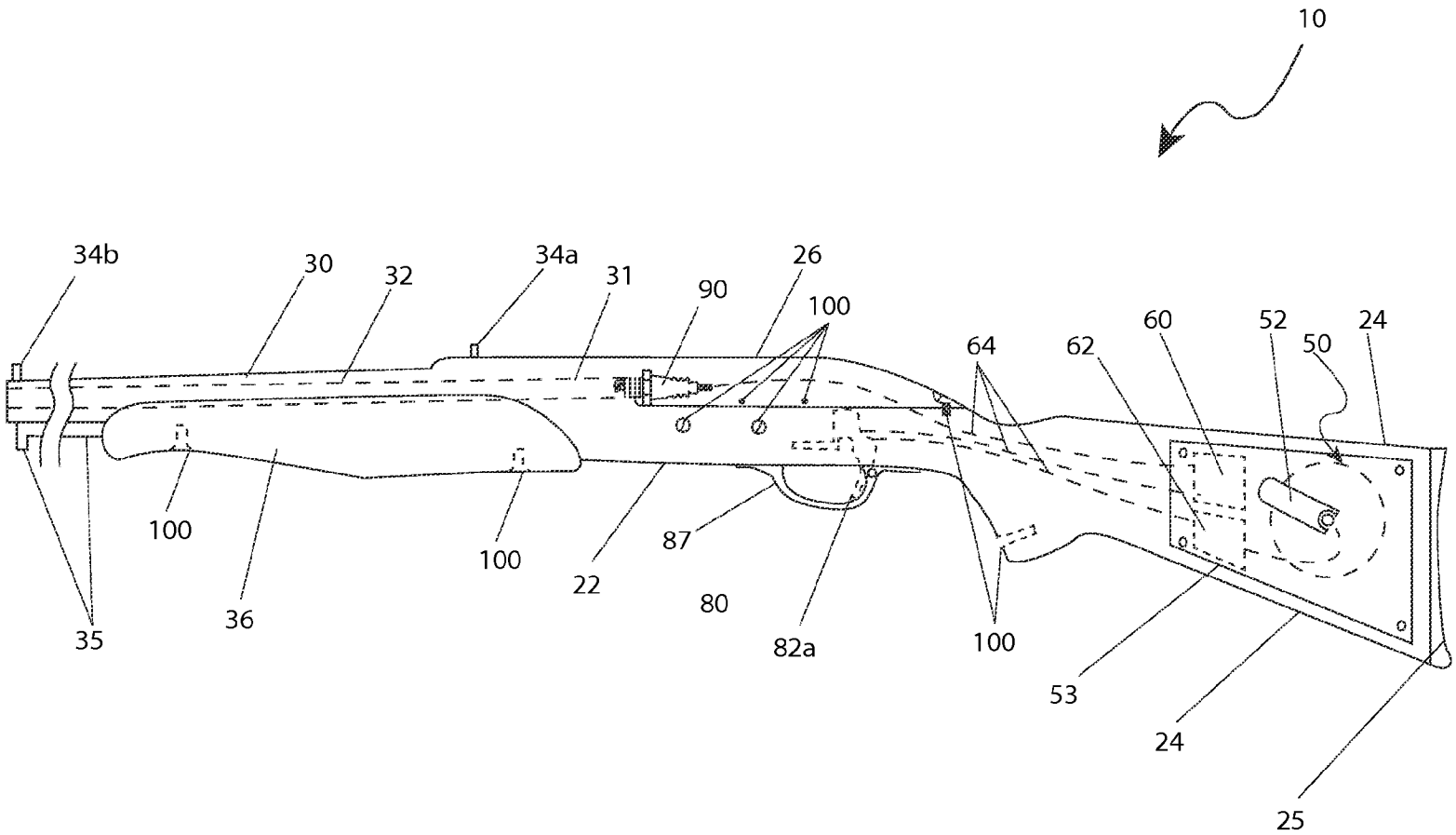
FIG. 1 is a perspective view of an electrically-ignited muzzle loader 10, according to a preferred embodiment of the present invention.

| DESCRIPTIVE KEY | |
|---|---|
| 10 | electrically-ignited muzzle loader |
| 22 | frame |
| 23 | cover bracket |
| 24 | stock |
| 25 | recoil pad |
| 26 | spark plug cover |
| 30 | barrel |
| 31 | chamber |
| 32 | bore |
| 34a | rear sight |
| 34b | front sight |
| 35 | ram rod |
| 36 | forestock |
| 50 | magneto assembly |
| 52a | crank arm |
| 52b | crank knob |
| 53 | magneto cover |
| 54a | crank aperture |
| 54b | crank recess |
| 54c | knob recess |
| 55 | stock cavity |
| 56 | stationary magnet |
| 57 | shaft |
| 58 | rotating magnet |
| 60 | coil |
| 62 | capacitor |
| 64 | wiring |

-continued

| DESCRIPTIVE KEY | |
|---|---|
| 66 | connector |
| 80 | trigger assembly |
| 82a | trigger lever |
| 82b | trigger pivot fastener |
| 83a | first point |
| 83b | second point |
| 84a | spring |
| 84b | spring anchor eyelet |
| 86 | stationary bracket |
| 87 | trigger guard |
| 88 | safety mechanism |
| 90 | spark plug |
| 91 | terminal |
| 100 | fastener |
| 102 | fastener aperture |

DETAILED DESCRIPTION OF THE PREFERRED EMBODIMENT

In accordance with the invention, the best mode is presented in terms of the described embodiments, herein depicted within FIGS. 1 through 4. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

The present invention describes an electrically-ignited muzzle loader (herein described as the "firearm") 10, which provides a muzzleloader-style firearm which utilizes an electric means to produce a spark during the firing of the firearm 10. The firearm 10 does not utilize a conventional flint and steel striking mechanism, but instead uses a spark plug 90 to ignite previously loaded black powder. Electricity to produce a spark at the spark plug 90 is produced by a wind-up-type magneto assembly 50 located within a stock portion 24 of the firearm 10.

Referring now to FIG. 1, a perspective view of the firearm 10, according to a preferred embodiment of the present invention, is disclosed. The firearm 10 comprises expected conventional features including a metal frame 22, a stock 24 with recoil pad 25, barrel 30 and bore 32 portions, a rear sight 34*a*, a front sight 34*b*, a ram rod 35, and a forestock 36. However, the firearm 10 also comprises internal portions which produce an electrical charge used to ignite the black powder.

The electric power is produced by a wind-up-type magneto assembly 50 located within a stock portion 24 of the firearm 10. Electrical current produced by the magneto assembly 50 is stored within a capacitor 62. A coil 60 is then used to boost the charge to a high voltage capable of jumping across a gap portion of the spark plug 90. A trigger assembly 80 utilizes a pair of points 83*a*, 83*b* to conduct the electrical charge to the spark plug 90 located within a breach end of the chamber 31. The spark from the spark plug 90 instantaneously ignites the black powder causing the firearm 10 to propel a projectile in a normal manner (see also FIGS. 2 and 3).

The muzzle loaded firearm 10 is envisioned being made of conventional materials used in the manufacturing of firearms such as metal, wood, composite plastic, and the like, and being assembled together using threaded fasteners 100.

Although the firearm 10 is illustrated here in a form of a rifle firearm, it is understood that the teachings of the firearm 10, particularly the electricity generating and ignition portions, may be incorporated into designs of other muzzle loaded firearms such as, but not limited to: handguns, cannons, and other firearms which utilize a closed breech section, and as such should not be interpreted as a limiting factor of the firearm 10.

Figure 2:
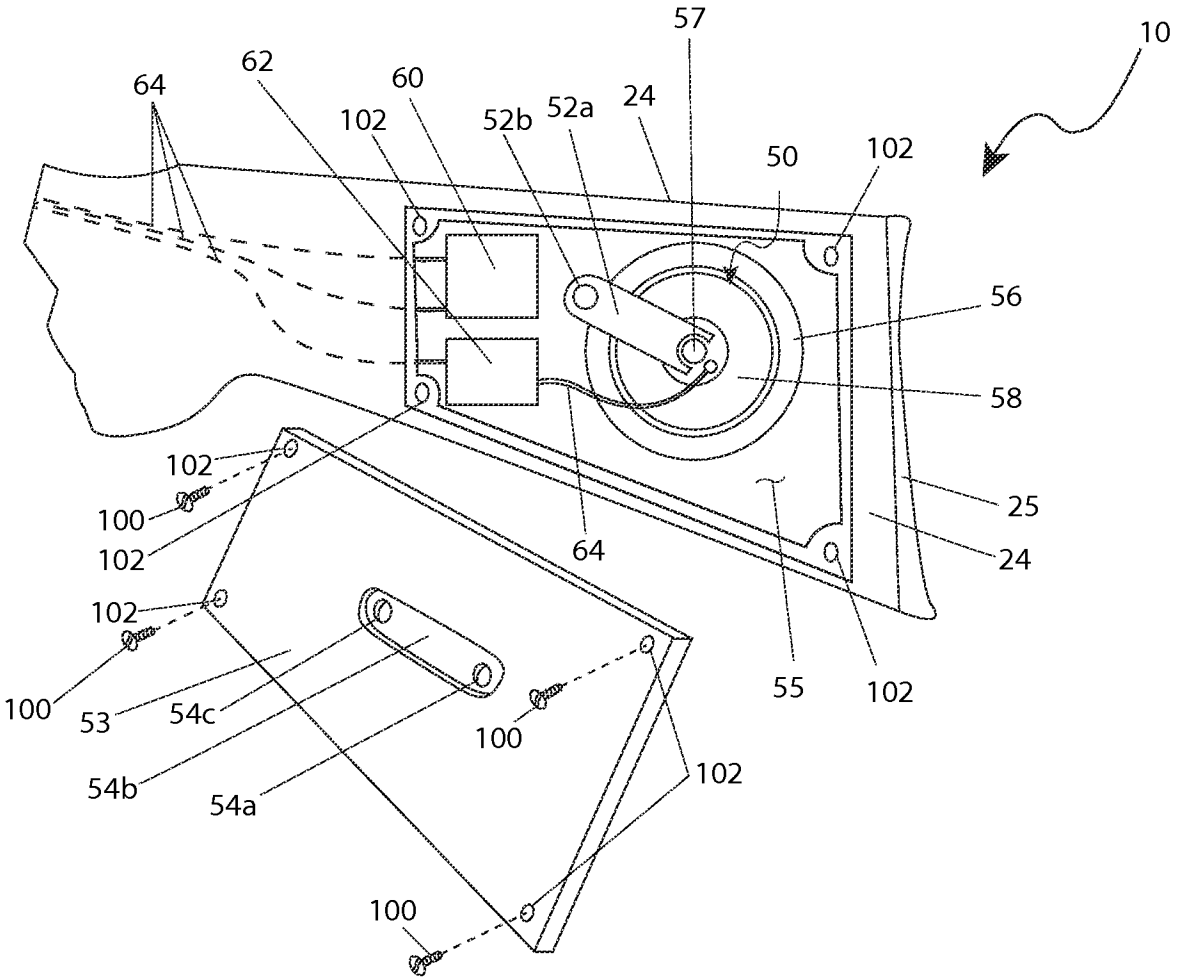
FIG. 2 is a close-up view of a trigger assembly portion 80 of the electrically-ignited muzzle loader 10, according to a preferred embodiment of the present invention.

Referring now to FIG. 2, a close-up view of a magneto assembly portion 50 of the firearm 10, according to a preferred embodiment of the present invention, is disclosed. The magneto assembly 50 comprises a wind-up-type device comprising conventional stationary magnet 56 and rotating magnet 58 portions. The centrally-located rotating magnet portion 58 further comprises a central shaft portion 57 being pivotingly attached to a crank arm 52*a*. The crank arm 52*a* further comprises an integral crank knob 52*b* which provides a means for the user to grasp and wind the magneto assembly 50. The magnet portions 56, 58 of the magneto assembly 50 are located discreetly within a stock cavity 55 within the stock 24 which is concealed by a flush-mounted magneto cover 53 being fastened to the stock 24 via a plurality of fasteners 100 and corresponding fastener apertures 102. The magneto cover 53 further comprises a crank aperture 54*a* which allows egress of the shaft portion 57 of the magneto assembly 50. Additionally, the magneto cover 53 comprises partial-depth crank recess 54*b* and knob recess 54*c* features which enable a user to flip the crank arm 52*a* one-hundred eighty degrees (180°) and insert the crank arm 52*a* and crank knob 54*b* portions discreetly within respective crank recess 54*b* and knob recess 54*c* features in a flush manner.

Figure 3:
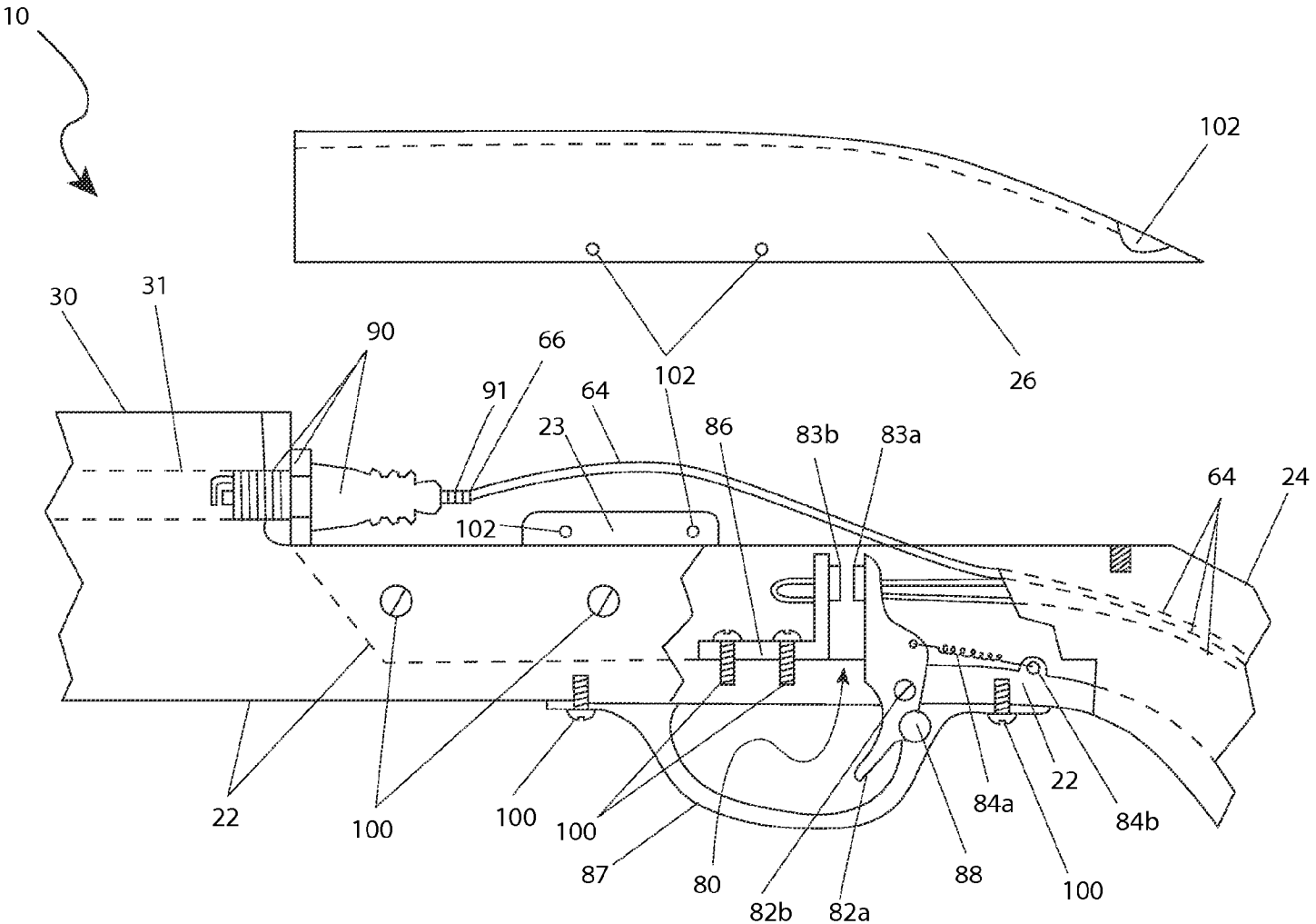
FIG. 3 is a close-up view of a magneto assembly portion 50 of the electrically-ignited muzzle loader 10, according to a preferred embodiment of the present invention; and, FIG. 4 is an electrical block diagram of the electrically-ignited muzzle loader 10, according to a preferred embodiment of the present invention.
Figure 4:
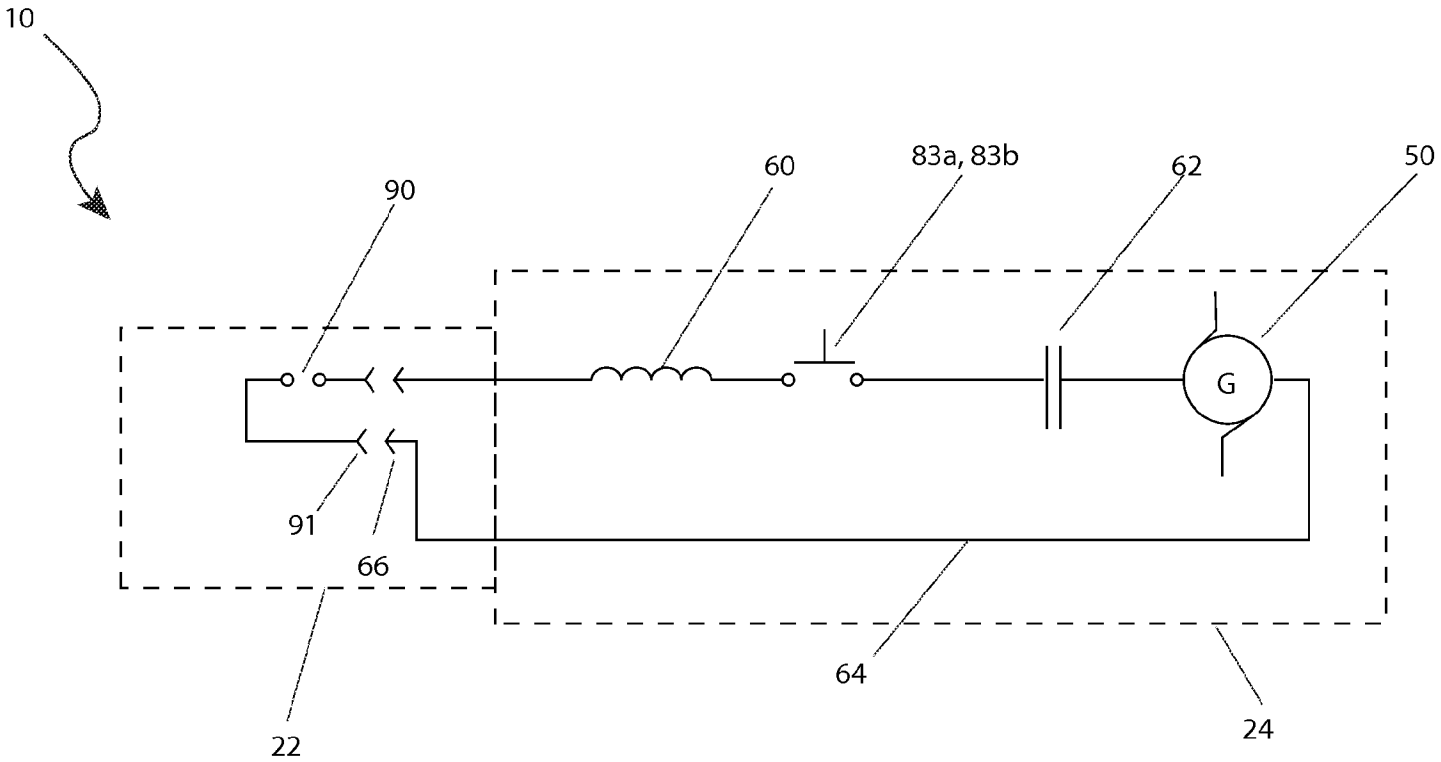

A simple circuit is formed by interconnection of the magneto assembly 50, the capacitor 62, the trigger assembly 80, and the coil 60 via a plurality of insulated wires 64 (see FIG. 4). The coil 60 and capacitor 62 portions are also mounted within the stock cavity 55. Electrical power from the magneto assembly 50 is stored within the capacitor 62 until the trigger assembly 80 closes the circuit (see FIG. 3), thereby allowing said electrical power to subsequently pass through the coil 60 to the spark plug 90. The coil 60 boosts the voltage of the electrical charge high enough to arc across a gap portion of the spark gap 90.

Referring now to FIG. 3, a close-up view of a trigger assembly portion 80 of the firearm 10, according to a preferred embodiment of the present invention, is disclosed. The trigger assembly 80 provides a means to close a circuit and thereby release electrical power stored within the capacitor 62 for conduction through the coil 60 and the spark plug 90. The trigger assembly 80 further comprises a trigger lever 82*a* having an integral first point portion 83*a*, and a stationary bracket 86 mounted to the frame 22 having an integral stationary second point portion 83*b*. The points 83*a*, 83*b* are in electrical communication with respective capacitor 62 and coil 60 portions via wiring 64. Activation of the trigger lever 82*a* by the user causes the points 83*a*, 83*b* to contact each other, thereby allowing current to flow through the circuit to the spark plug 90. The trigger lever 82*a* is pivotingly attached to the frame portion 22 of the firearm 10 via a trigger pivot fastener 82*b* such as a shoulder screw or the like. A lower end portion of the trigger lever 82*a* is biased in a forward direction via a spring 84*a* and a stationary spring anchor eyelet portion 84*b* of the frame 22 to maintain a normally-open condition of the points 83*a*, 83*b*. Additionally, the trigger assembly 80 comprises a conventional sliding-cylinder-type safety mechanism 88 being integrated into a trigger guard portion 87 of the trigger assembly 80.

The firearm 10 further comprises a half-cylinder-shaped spark plug cover 26 located above the trigger assembly 80 which provides a removably attachable means to access the spark plug 90 to perform maintenance or replacement tasks as needed. The spark plug cover 26 provides an aesthetic smooth transition between the barrel 30 and the stock 24 portions in a flush manner and is affixed to opposing internal cover bracket portions 23 of the frame 22 via a plurality of fasteners 100 and corresponding fastener apertures 102.

The spark plug 90 is envisioned to be similar to those in motor vehicles and in like manner is threadingly inserted into the breach end of the barrel 30 of the firearm 10 having electrode portions of the spark plug 90 extending into the chamber portion 31 of the barrel 30. An insulated wire 64 housed within the spark plug cover 26 extends from the coil 60 and is connected to a terminal end portion 91 of the spark plug 90 via a connector 66 being soldered or crimped to the wire 64.

Referring now to FIG. 4, an electrical block diagram of the firearm 10, according to a preferred embodiment of the present invention, is disclosed. The firearm 10 provides a simple direct current (DC) circuit which conducts electricity generated by the magneto assembly 50 through wiring 64 to the capacitor 62 which stores the electric charge until a user closes the circuit by closing the first 83*a* and second 83*b* points, thereby allowing the capacitor 62 to discharge through the voltage-increasing coil 60. The high-voltage charge is then conducted to the spark plug 90 to produce a spark to ignite the black powder fuel.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the firearm 10, it would be utilized as indicated in FIGS. 1 through 3.

The method of utilizing the firearm 10 may be achieved by performing the following steps: procuring the firearm 10; proceeding to a safe location suitable for firing the firearm 10; setting the safety mechanism 88 to a "safe" position; preloading black powder, wadding, and projectile portions into the bore 32 and chamber 31 portions of the barrel 30 in a conventional manner using the ram rod 35; flipping the crank arm outwardly one-hundred eighty degrees (180°) to expose the crank knob 52*b*; grasping the crank knob portion 52*b*; rotating the crank arm 52*a* a sufficient number of revolutions to charge the capacitor 62; returning the crank arm 52*a* into the crank recess 54*b*; positioning the firearm 10 against a user's shoulder to assume a shooting posture; sliding the safety mechanism 88 to a "ready" position; aiming the firearm 10 using the rear 34*a* and front 34*b* sights in a normal manner; firing the firearm 10 at an intended target by squeezing the trigger lever 82*a*; causing the points 83*a*, 83*b* to close and cause the spark plug 90 to produce a spark; igniting the black powder to fire the projectile at the target; repeating the firearm loading and firing steps described above for subsequent firing of projectiles from the firearm 10; and, benefiting from an easily renewable ignition source and improved ignition reliability of a firearm afforded a user of the present invention 10.

The spark plug 90 and magneto assembly 50 may be accessed and maintained as needed by removing respective spark plug cover 26 and magneto cover 53 portions by removing the respective fasteners 100. It is envisioned that the spark plug 90 will require periodic cleaning and replacement. Additionally, removal of the spark plug cover 26 and spark plug 90 is envisioned to improve a user's ability to clean and inspect the barrel 30 using a standard firearm cleaning kit The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An ignition mechanism configured for use with a firearm, comprising:

a magneto assembly in electrical communication with a capacitor and adaptably located within a stock of said firearm;

said capacitor in electrical communication with said magneto assembly located within said stock;

a coil in electrical communication with said capacitor located within said stock;

a trigger assembly in electrical communication with said coil, mounted to an external surface of said firearm; and, a spark plug located within a breach end of a chamber of said firearm and in electrical communication with said trigger assembly;

wherein said magneto assembly produces a current and delivers said current to said capacitor;

wherein said capacitor stores said current;

wherein when said trigger assembly is activated, said current is conducted from said capacitor to said coil;

wherein said coil boosts said current to an increased voltage and conducts said current with increased voltage to said spark plug; and, wherein said spark plug produces a spark upon receipt of said current with said increased voltage to ignite gunpowder loaded within said chamber upstream of said spark plug.

2. The mechanism of claim 1, wherein said magneto assembly further comprises a wind-up device.

3. The mechanism of claim 2, wherein said magneto assembly further comprises:

a stationary magnet;

a rotating magnet, comprising a central shaft portion pivotingly attached to a first end of a crank arm; and, a crank knob located on a second end of said crank arm.

4. The mechanism of claim 3, further comprising a magneto assembly cover located on said stock to conceal said magneto assembly, further comprising:

an aperture permitting passage of said crank arm therethrough, such that said crank knob is external of said magneto assembly cover; and, a crank recess located on an outer surface of said magneto assembly cover and extending outward from said aperture;

wherein said crank arm and crank knob can selectively reside within said crank recess flush with a surface of said magneto assembly cover.

5. The mechanism of claim 1, wherein said trigger assembly further comprises;

a trigger lever pivotally attached to a frame of said firearm, further including a first point portion residing within said firearm and a lower portion extending outward from said firearm;

a stationary bracket mounted to a frame of said firearm adjacent to said trigger lever, further including a stationary second point portion residing within said firearm; and, a trigger guard mounted to said frame and adjacent to and bracketing said trigger lever;

wherein said first point portion is in electrical communication with said capacitor;

wherein said second point portion is in electrical communication with said coil;

wherein said trigger lever is biased to provide no contact between said first point portion and said second point portion;

wherein activation of said trigger lever operably motions said first point portion to contact said second point portion, thereby enabling said current to flow from said capacitor to said coil; and, wherein release of said trigger lever operably motions said first point portion away from contacting said second point portion, thereby ceasing flow of said current.

6. The mechanism of claim 5, wherein said lower end of said trigger lever opposite said first point portion is biased in a forward direction via a spring anchored to said frame adjacent to said trigger lever.

7. The mechanism of claim 6, further comprising a safety mechanism integrated into said trigger guard portion.

8. The mechanism of claim 7, wherein said safety mechanism is a sliding cylinder safety mechanism.

9. The mechanism of claim 1, further comprising a spark plug cover located on said firearm adjacent to said trigger assembly.

10. A firearm having an ignition mechanism, comprising:

a frame, a stock with a recoil pad, a barrel and bore, a chamber, a ram rod, and a forestock;

a magneto assembly in electrical communication with a capacitor located within said stock;

said capacitor in electrical communication with said magneto assembly located within said stock;

a coil in electrical communication with said capacitor located within said stock;

a trigger assembly in electrical communication with said coil, mounted to an external surface of said frame; and, a spark plug located within a breach end of said chamber and in electrical communication with said trigger assembly;

wherein said magneto assembly produces a current and delivers said current to said capacitor;

wherein said capacitor stores said current;

wherein when said trigger assembly is activated, said current is conducted from said capacitor to said coil;

wherein said coil boosts said current to an increased voltage and conducts said current with increased voltage to said spark plug; and, wherein said spark plug produces a spark upon receipt of said current with said increased voltage to ignite gunpowder loaded within said chamber upstream of said spark plug.

11. The firearm of claim 10, further comprising a rear sight and a front sight.

12. The firearm of claim 11, wherein said firearm is a muzzle loader.

13. The mechanism of claim 1, wherein said magneto assembly further comprises a wind-up device.

14. The mechanism of claim 13, wherein said magneto assembly further comprises:

a stationary magnet;

a rotating magnet, comprising a central shaft portion pivotingly attached to a first end of a crank arm; and, a crank knob located on a second end of said crank arm.

15. The mechanism of claim 14, further comprising a magneto assembly cover located on said stock to conceal said magneto assembly, further comprising:

an aperture permitting passage of said crank arm therethrough, such that said crank knob is external of said magneto assembly cover; and, a crank recess located on an outer surface of said magneto assembly cover and extending outward from said aperture;

wherein said crank arm and crank knob can selectively reside within said crank recess flush with a surface of said magneto assembly cover.

16. The mechanism of claim 10, wherein said trigger assembly further comprises;

a trigger lever pivotally attached to said frame, further including a first point portion residing within said firearm and a lower portion extending outward from said firearm;

a stationary bracket mounted to a frame of said firearm adjacent to said trigger lever, further including a stationary second point portion residing within said firearm; and, a trigger guard mounted to said frame and adjacent to and bracketing said trigger lever;

wherein said first point portion is in electrical communication with said capacitor;

wherein said second point portion is in electrical communication with said coil;

wherein said trigger lever is biased to provide no contact between said first point portion and said second point portion;

wherein activation of said trigger lever operably motions said first point portion to contact said second point portion, thereby enabling said current to flow from said capacitor to said coil; and, wherein release of said trigger lever operably motions said first point portion away from contacting said second point portion, thereby ceasing flow of said current.

17. The mechanism of claim 16, wherein said lower end of said trigger lever opposite said first point portion is biased in a forward direction via a spring anchored to said frame adjacent to said trigger lever.

18. The mechanism of claim 17, further comprising a safety mechanism integrated into said trigger guard portion.

19. The mechanism of claim 18, wherein said safety mechanism is a sliding cylinder safety mechanism.

20. The mechanism of claim 10, further comprising a spark plug cover located on said firearm adjacent to said trigger assembly.

* * * * *